United States Patent [19]

Ralph

[11] Patent Number: 4,553,361

[45] Date of Patent: Nov. 19, 1985

[54] TIERED DRAIN CHANNEL FOR EXTRUDED DOOR INSERT

[75] Inventor: James L. Ralph, Shoreview, Minn.

[73] Assignee: Cole Sewell Corporation, St. Paul, Minn.

[21] Appl. No.: 627,825

[22] Filed: Jul. 5, 1984

[51] Int. Cl.[4] ..... E06B 7/14; E06B 3/46

[52] U.S. Cl. ..... 52/209; 49/408; 49/476; 52/304; 52/788

[58] Field of Search ..... 52/171, 209, 304, 788, 52/790, 789, 788; 49/408, 471, 476; 160/44, 89–92

[56] References Cited

U.S. PATENT DOCUMENTS

| | | | |
|---|---|---|---|
| 1,485,307 | 2/1924 | Steckenreiter | 52/209 |
| 2,733,487 | 2/1956 | Hauck | 52/209 |
| 2,787,034 | 4/1957 | Hauck | 52/209 |
| 2,939,188 | 6/1960 | Wahlfeld | 160/91 |
| 3,269,452 | 8/1966 | Pirozzi | 160/90 |
| 3,410,027 | 11/1968 | Bates | 52/209 X |
| 3,555,736 | 1/1971 | Koch, Jr. et al. | 52/209 X |
| 3,570,182 | 3/1971 | Bakke | 52/209 X |
| 4,003,171 | 1/1977 | Mitchell | 49/476 |

FOREIGN PATENT DOCUMENTS

| | | | |
|---|---|---|---|
| 45284 | 2/1974 | Australia | 49/471 |
| 1060268 | 8/1979 | Canada | 52/788 |
| 231678 | 2/1964 | Fed. Rep. of Germany | 52/788 |
| 339366 | 8/1959 | Switzerland | 52/209 |

*Primary Examiner*—Donald G. Kelly
*Assistant Examiner*—Richard Chilcot, Jr.
*Attorney, Agent, or Firm*—Leo Gregory

[57] ABSTRACT

This invention relates to an interior drainage formed in a channel extrusion for a door frame insert having a combination of glass and screen members wherein the interior of the upper frame structure drains downwardly and the bottom horizontal member of the frame has an interior tiered construction which receives the moisture from above and has mitred corners whereby the respective tiers drain downwardly and underlying the ends of the bottom tier hidden from view are drain passages to the atmosphere.

8 Claims, 6 Drawing Figures

TIERED DRAIN CHANNEL FOR EXTRUDED DOOR INSERT

BACKGROUND OF THE INVENTION

1. Field Of Invention

This invention relates to extrusions for a door frame insert which comprises a combination of glass and screen elements.

2. Description Of The Prior Art

Hollow formed extrusions for door frames are known in the art. Moisture leaks into the interior of the extrusions and collects in the bottom channel. Frequently a weep hole is formed in the facing of the bottom molding strip. However it is not known that there is any drainage designed into an extrusion to discharge all of the moisture therein.

SUMMARY OF THE INVENTION

It is the purpose and a principal object of this invention to provide for a door or window frame an extrusion which has a specifically designed internal drainage which effectively collects and discharges all of the moisture which may leak into such extrusion. The leakage of moisture into the frame is an unavoidable incident of the structure.

It is a particular object of the invention herein to provide an extruded frame of the type above indicated wherein the bottom horizontal frame member has a tiered channel for each track of said frame wherein the moisture passes downwardly through corresponding tracks to said bottom horizontal member and said tiers drain at their ends and discharge said moisture through hidden weep holes in said bottom frame portion.

It is also an object of the invention herein to provide hidden drain passages which are formed in the process of forming the extrusion and require no other fabrication.

These and other objects and advantages of the invention will be set forth in the following description made in connection with the accompanying drawings in which like reference characters refer to similar parts throughout the several views.

DESCRIPTION OF A PREFERRED EMBODIMENT

Figure 2:
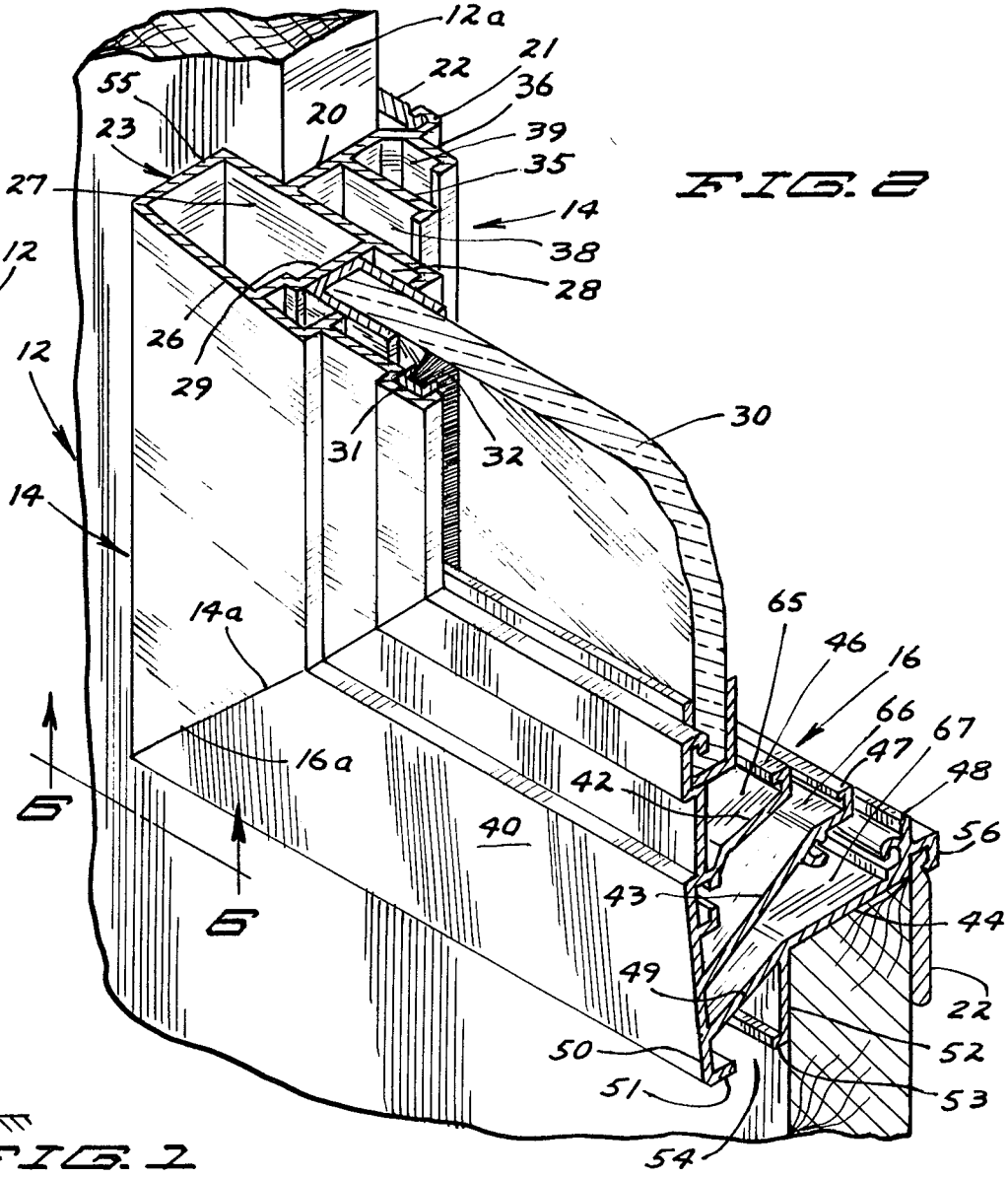
FIG. 2 is a fragmentary view in perspective showing detail of structure.
Figure 1:
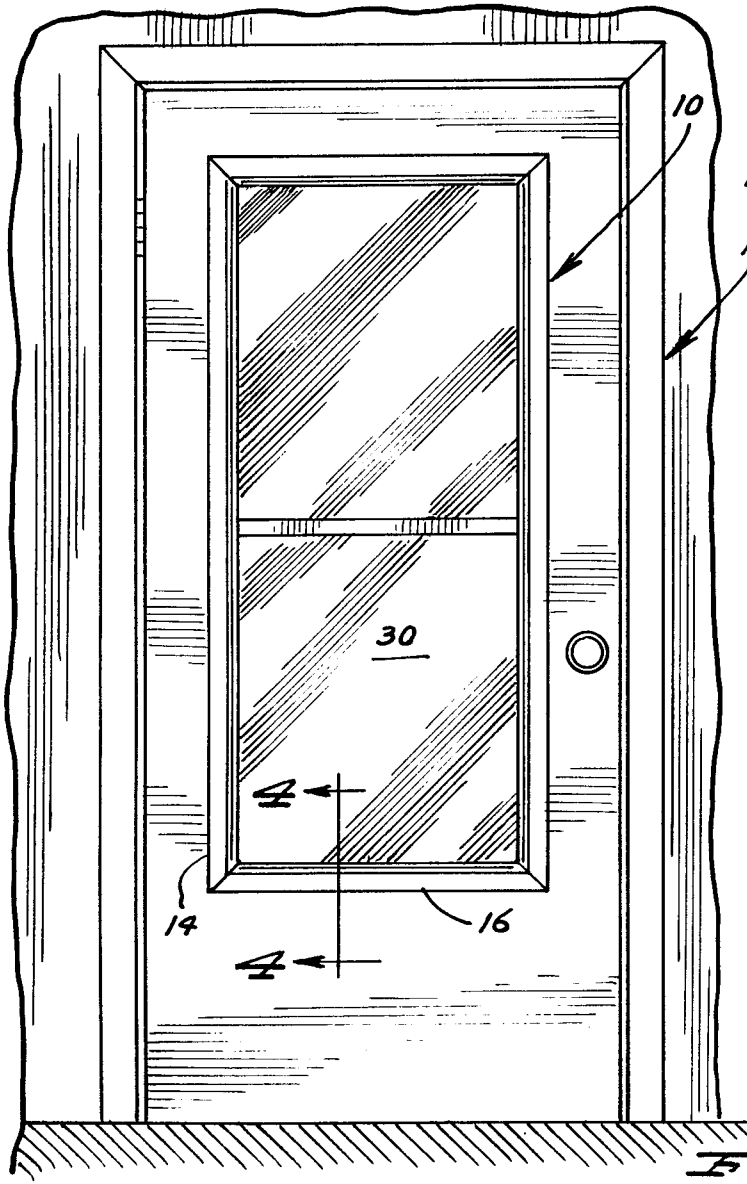
FIG. 1 is a view in front elevation of a door structure embodying the invention herein.
Figure 4:
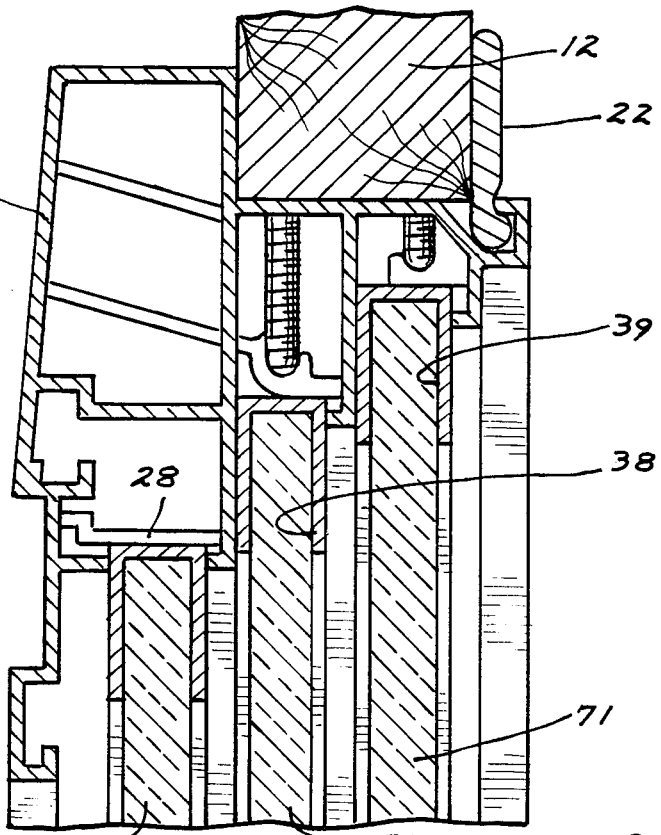
FIG. 4 is a fragmentary view in horizontal section taken on line 4—4 of FIG. 3 as indicated.

Referring to the drawings, the extruded frame structure comprising the invention herein is indicated generally by the reference numeral 10 and is illustrated installed as an insert into the core or opening 12*a* of the door structure 12.

The invention is particularly adapted for making up combination doors and windows which consist of a pair of glass pane or sash members and a screen member with each being carried in a separate track for the various relative positions in which they may be positioned to provide ventilation. For convenience both glass pane and screen members are referred to herein as sash or sash members. The disclosure herein will relate to door frame inserts but this is for purpose of illustration only and not for limitation.

As will be noted, the bottom horizontal portion of the extruded frame has a drainage tier or shelf for each channel with the upper such tiers draining down onto the lower tiers of said bottom horizontal portion and said bottom portions have hidden weep holes for drainage to the atmosphere.

The assembly of the frame portions or segments into a unitary frame structure is well known in the art and not here described and further, the mounting of the frame as an insert into the core opening of a door, as into the core 12*a* of the door structure 12, is well known and is not described.

With reference to FIG. 2, sufficient detail of structure is shown to disclose adequately the novel structure comprising the invention herein.

Shown mounted in the core 12*a* of the door 12 are a vertical frame segment or jamb strip 14 and a horizontal segment or sill strip 16. The segment 14 as described will be representative of the extrusion forming the top segment and the other side segment of the frame structure.

The segment 14 has a back wall 20 of a width corresponding to the width of the core 12*a*. Projecting laterally inwardly is a short hooked portion 21 to receive an interengaging portion of a locking strip 22 which is suitably secured to the adjacent portion of the door structure.

Projecting outwardly of said wall 20 is a rectangular channel portion 23 which partially overlies the outer wall of said door adjacent said core and has spaced wall portions 26 and 27 extending forwardly to form therebetween a track 28 having a backing wall 29 and shown disposed into said track is a sash member 30.

Said wall 26 is configured to have an inwardly facing channel 31 into which is retained a sealing strip 32.

Extending forwardly of said wall 20 are spaced walls 35 and 36 having inwardly angled ends as shown and which taken with the wall 27 form therebetween the tracks 38 and 39.

The horizontal extruded sill portion or segment 16 comprises the novel structure of the invention herein. Said segment has an outside wall 40 which corresponds to the wall 26. Said wall 40 has projecting inwardly thereof and cantilevered therefrom vertically spaced tiers or shelves 42, 43 and 44 and at their inner ends have upwardly projecting inwardly angled flanges 46, 47 and 48 of short height. Said tier 42 declines adjacent and toward the wall 40 to form a drain path 42*a*. Said tier 43 is shown to be inclined upwardly and the flange 44 is shown to form a bottom wall to rest upon the bottom wall of the core 12*a* and having a downwardly inclined portion 49 extending to the wall 40.

Said wall 40 extends below the inclined portion 49 having a depending wall portion 50 angled inwardly as at 51 and having spaced inwardly thereof to overlie the adjacent wall of the door 12 a depending wall 52 having an inwardly angled flange 53 facing the flange 51. Said walls 50 and 52 form an open bottom channel 54 therebetween.

Curved outwardly and downwardly of said flange 48 is a hook like portion 56 on the order of the projection 21 and is adapted to receive and interengage with a securing strip 22 as above described.

Said tiers or shelves 42, 43 and 44 form the essential and novel structure of an internal drainage system which is formed as an integral part of the extrusion.

Figure 5:
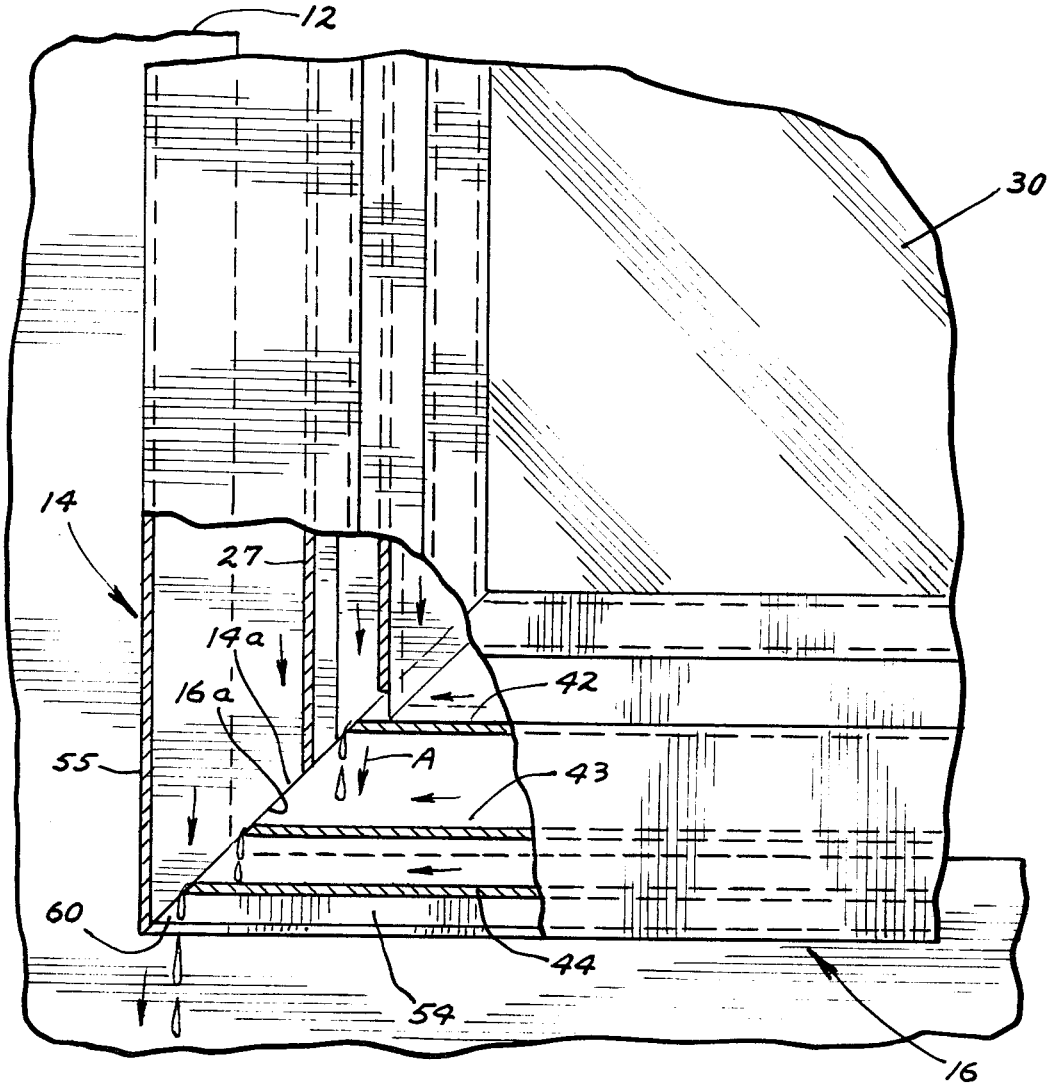
FIG. 5 is a fragmentary view in front elevation having a portion thereof broken away.

The ends of the segments of said frame 10 are mitre cut to abut and be jointed as at 14*a* and 16*a* as shown in FIGS. 2 and 5. Said ends are secured in a conventional manner as with metal screws not here described.

Referring to FIG. 5, the mitre cut of one end portion 16*a* of segment 16 is shown abutting the adjacent mitre cut end portion 14*a* of the segment 14.

Figure 6:
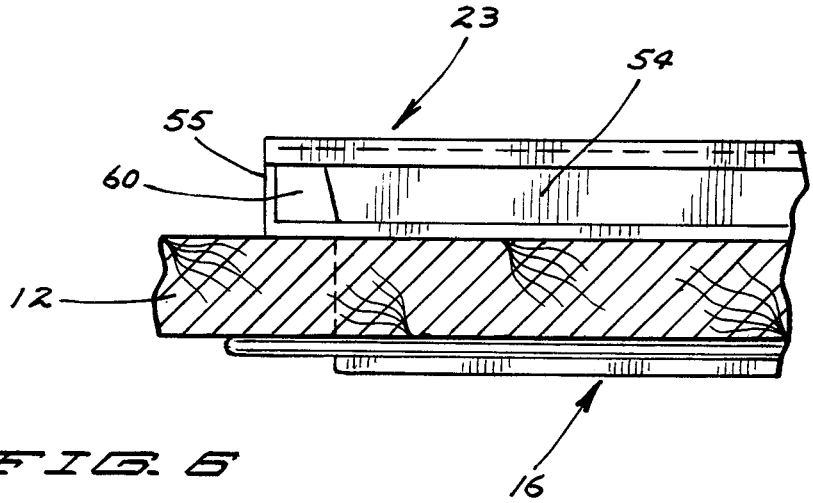
FIG. 6 is a broken view in bottom plan and partially in section taken on line 6—6 of FIG. 2 as indicated.

The mitre cut of the end portions of the segment 16 causes the ends of said tiers to have a stepped relationship as indicated in FIG. 5 and the drain path of moisture is indicated by the arrows A and the drainage of said moisture is through the weep holes 60 at each end of the segment 16 and of which one is shown in FIGS. 5 and 6.

The mitre cut causes the tier 44 to be cut short of the end of the underlying open bottom channel 54 and with the adjacent end wall 55 of the projected portion 23 of the segment 14 forms the weep holes 60 (FIG. 5).

Thus the weep holes 60 are formed in the process of making mitre cuts and require no extra or special fabrication and said weep holes are hidden from view as shown and do not detract from the exterior appearance of the segment 16.

The channels formed in the extrusion of the jamb or side strips and the top cross member are open channels. Moisture leaking into the extruded frame structure drains naturally downwardly onto the tiered drainways formed as described in connection with the segment 16 and thence as indicated in FIG. 5, the moisture drains out of the weep holes 60 to the atmosphere.

Referring to FIG. 2, it is seen that the weep holes 60 are formed at the ends of the tier portion 49 which projects outwardly of the door structure 12 and can drop without dripping upon the adjacent surface of the door 12.

Figure 3:
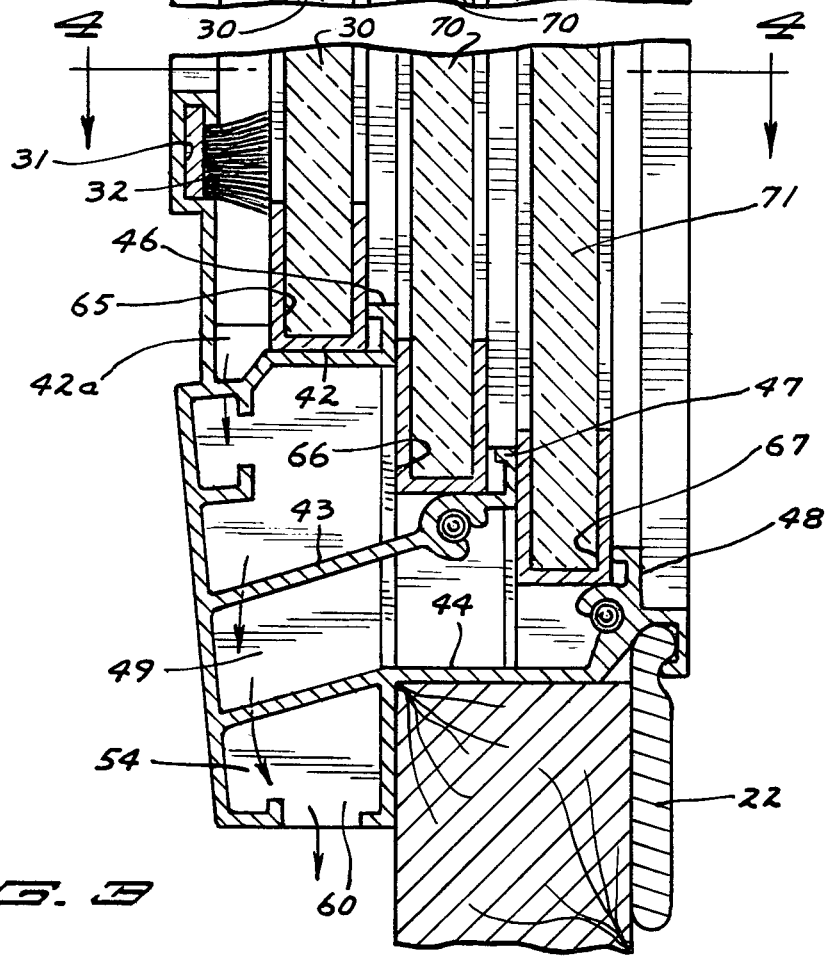
FIG. 3 is a fragmentary view in vertical section showing detail of structure.

Referring to FIG. 3, it will be seen that the flange 46 is spaced from the facing configured side of the wall 40 to form one sash track 65. The space between the vertical planes of the flanges 46 and 47 forms a sash member track 46 and the space between the vertical planes of the flanges 47 and 48 forms a sash member track 67. Shown in tracks 66 and 67 are sash members 70 and 71. In practice, the member 71 may be a screen member.

With particular reference to FIG. 5, it is believed with the description above given that the function of said frame 10 should be clearly understood. In fabricating said frame member 10 with the tier construction of the sill member 16 and the mitred corner or end cuts, the tiers naturally drain downwardly at their respective ends and there is a complete discharge of moisture through the weep holes 60 which also are formed as a result of the mitre end cuts whereby no special fabrication is required to form said weep holes.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. An extruded channel frame member forming a core insert for a door structure, comprising a substantially rectangular frame member having the facing portion thereof projecting outwardly of said door structure, the bottom segment of said frame member having a plurality of vertically spaced tiers therein extending inwardly of said frame from the inner side of said facing portion, said tiers having their inner edge portions and their end portions in stepped relation, a sash receiving track formed between said facing portion and the inner edge of the uppermost of said tiers, sash receiving tracks formed within the vertical spacing between adjacent stepped pairs of said edge portions, vertical drain passages formed between said stepped end portions of said tiers and the respective adjacent vertical end walls of said frame member, an open bottom channel depending from the lowermost of said tiers, and drainage holes to the atmosphere through said channels formed between the ends of said last mentioned tier and said adjacent end walls.

2. The structure of claim 1, including sash receiving tracks in the side and top segments of said frame corresponding to said sash tracks formed in said bottom segment.

3. The structure of claim 1, including upwardly angled flanges formed along said inner edge portions of said tiers.

4. The structure of claim 1, wherein said tiers have portions angled downwardly adjacent said inner side of said facing portion.

5. The structure of claim 1, wherein said open bottom channel depends from said facing portion projecting outwardly of said door structure.

6. The structure of claim 1, wherein said drainage holes are formed in said projecting facing portion of said frame member whereby drainage from said drain holes falls clear of the adjacent door structure.

7. The structure of claim 1, wherein an upward projection of said facing portion forms the outer wall of said first mentioned sash channel.

8. An extruded channel frame member forming a core insert for a door structure, comprising a bottom frame segment having an outer wall portion projecting outwardly of said door structure, a plurality of tiers vertically spaced cantilevered inwardly of said frame segment from said outer wall portion forming drain channels, said tiers having successively greater widths and having upwardly flanged inner edge portions, the lowermost of said tiers having a portion thereof spaced from said projecting portion forming a bottom wall, the uppermost of said tiers and a corresponding upward projection of said outer wall portion forming a track to receive a sash member, a sash track formed in the vertical space between the inner flanged edge of the uppermost of said tiers and the directly underlying of said tiers, a sash track formed in the vertical space between the inner flanged edge portions of said underlying of said tiers and of the lowermost of said tiers, said frame segment having its ends mitre cut to have the same in a stepped relation, the lowermost of said tiers having its respective end portions set back from the adjacent sidewalls of said frame member forming drain holes therebetween, and said last mentioned tier having an open bottom channel thereunder through which said drain holes discharge to the atmosphere.

* * * * *